United States Patent [19]

Blisko et al.

[11] 3,930,483

[45] Jan. 6, 1976

[54] APPARATUS FOR SUPPLYING FUEL TO A FUEL-INJECTED ENGINE

[75] Inventors: Charles M. Blisko, Southfield; Ronald T. Denton, Birmingham; Kazimieras Kizlauskas, Southfield, all of Mich.

[73] Assignee: Ford Motor Company, Dearborn, Mich.

[22] Filed: June 24, 1974

[21] Appl. No.: 482,720

[52] U.S. Cl.... 123/139 AW; 123/119 R; 123/52 M; 239/550

[51] Int. Cl.[2] ..... F02M 55/00

[58] Field of Search..... 123/119 R, 139 AW, 139 E, 123/32 R, 32 EA, 32 AE, 52 M, 179 L; 239/550

[56] References Cited

UNITED STATES PATENTS

| | | | |
|---|---|---|---|
| 2,893,365 | 7/1959 | Halfner | 123/119 R |
| 3,776,209 | 12/1973 | Wertheimer et al. | 123/139 AW |
| 3,783,844 | 1/1974 | Gural | 123/139 AW |
| 3,835,819 | 9/1974 | Anderson | 123/139 AW |
| 3,845,748 | 11/1974 | Eisenberg | 123/32 R |

*Primary Examiner*—Wendell E. Burns

*Attorney, Agent, or Firm*—Robert W. Brown; Keith L. Zerschling

[57] ABSTRACT

Improved apparatus for supplying fuel to one or more fuel injectors used to inject fuel into a combustion engine. In the preferred form, each of the fuel injectors has its discharge port positioned in the engine intake manifold and a clamp retains the injector in position thereon. The clamp has a first portion that has a passage for receiving the inlet conduit to the fuel injector. Also, this portion of the clamp has inlet and outlet passages in communication with the passage receiving the injector inlet conduit so that fuel supplied to the inlet passage flows into the inlet conduit of the fuel injector and also flows out of the outlet passage. A second portion of the clamp is used for securing the clamp to the engine intake manifold. The fuel injector is located between the first portion of the clamp and the intake manifold. Flexible conduit may be used to connect the outlet passage of one clamp with the inlet passage to another clamp. A pressure regulator may be provided for regulating the pressure of the fuel flowing through the various clamps and flexible tubing.

1 Claim, 7 Drawing Figures

APPARATUS FOR SUPPLYING FUEL TO A FUEL-INJECTED ENGINE

BACKGROUND

This invention relates to improved apparatus for supplying fuel to one or more fuel injectors used to inject fuel into a combustion engine. More particularly, it relates to the use of a clamp with each of these injectors not only to position the fuel injectors but also to supply fuel to them. Also, the invention relates to the use of flexible conduit to interconnect the inlets and outlets of the various clamps supplying fuel to the fuel injectors.

Prior art U.S. Patents which may be of interest are as follows: Parsons 2,687,123; Haefner 2,893,365; Humber et al. 2,989,044; Armstrong et al. 3,006,329; Phillips et al. 3,026,928; Long 3,500,802 and 3,500,803; and Bloomfield 3,596,640. Of these patents, perhaps the first three are most pertinent to the present invention.

SUMMARY OF THE INVENTION

It is an object of the invention to provide improved apparatus for supplying fuel to fuel injectors for a combustion engine.

Another object of the invention is to provide apparatus for positioning and retaining fuel injectors on an engine and to use such positioning and retaining apparatus also to supply the fuel to the individual injectors.

A further object of the invention is to reduce the magnitude of transient pressure fluctuations in the fuel supply apparatus.

A still further object of the invention is to provide improved fuel supply apparatus which permits the removal of a single fuel injector to permit its repair or replacement.

Another object of the invention is to reduce the degree of heat transfer from the engine to the fuel supply system and to provide improved vapor-purging capability.

A more specific object is to provide an improved fuel supply system capable of delivery of fuel at an average pressure of 39 Psi to engine-mounted fuel injectors.

These and other objects of the invention are accomplished with an improved fuel supply system which utilizes clamps that not only have means for retaining and positioning an individual fuel injector on the combustion engine, but which also have a portion which receives the fuel inlet conduit of such fuel injector. This portion of the clamp has inlet and outlet passages. Fuel is supplied to the inlet passages which communicates with the inlet conduit to the fuel injector to permit fuel to be supplied to it. Preferably, the outlet of one fuel injector is connected to the inlet of an adjacent fuel injector by a flexible conduit, such as a rubber hose. In engines having a plurality of fuel injectors, the clamps supplying fuel to the individual injectors may have their inlet and outlet openings connected in parallel or in series. One group of series-connected fuel-supplying clamps may be connected in parallel with a second group of series-connected fuel-supplying clamps.

The invention may be better understood by reference to the detailed description which follows and to the drawings.

DETAILED DESCRIPTION

With reference now to the drawings, wherein like numerals refer to like parts in the several views, there is shown an improved fuel supply apparatus, generally designated by the numeral 10, mounted on the intake manifold 12 of an internal combustion engine. Air enters the engine through intake openings 13 in the intake manifold.

Figure 1:
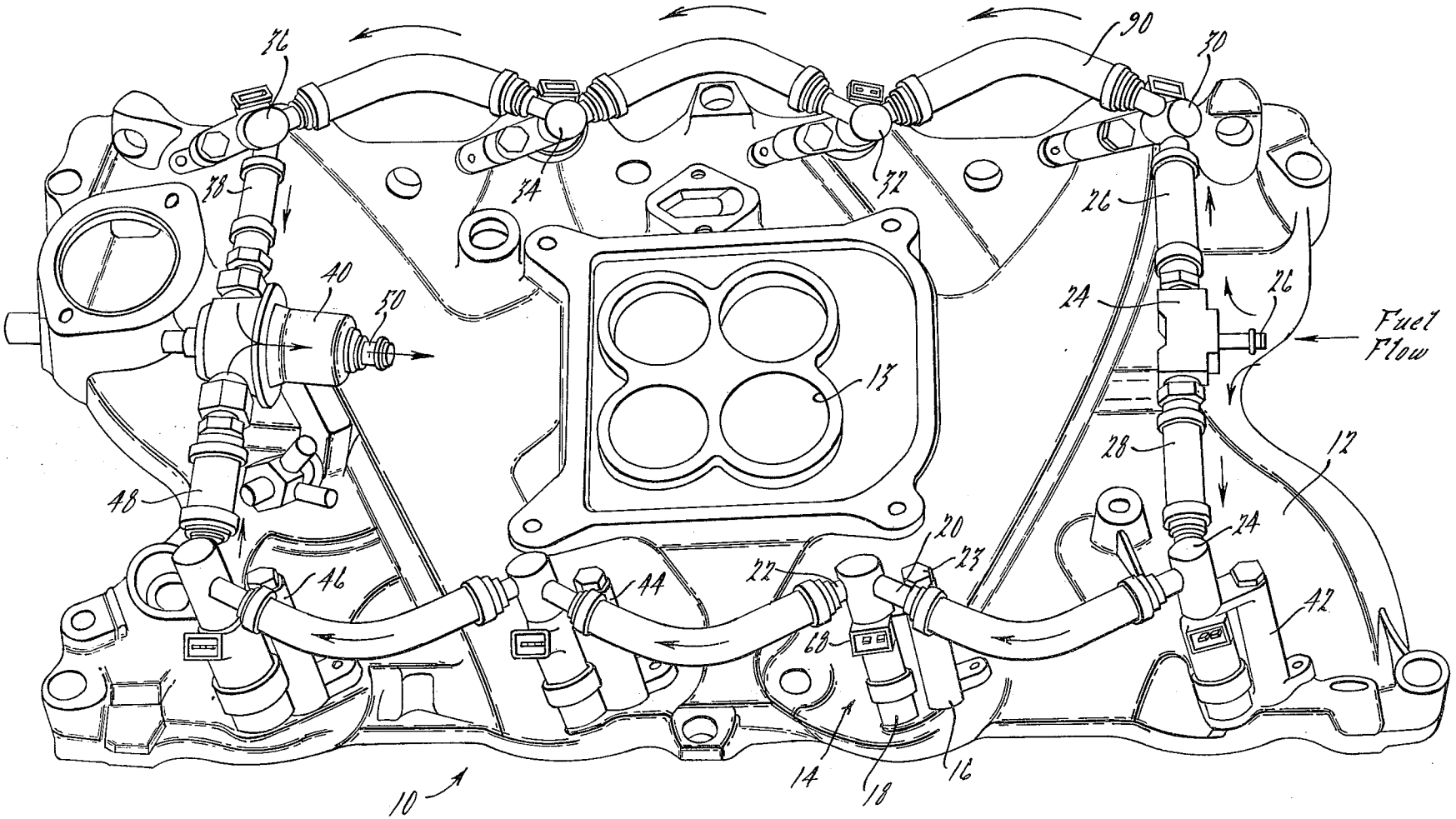
FIG. 1 is a perspective view of improved apparatus in accordance with the invention for supplying fuel to fuel injectors mounted on the intake manifold of an internal combustion engine.
Figure 2:
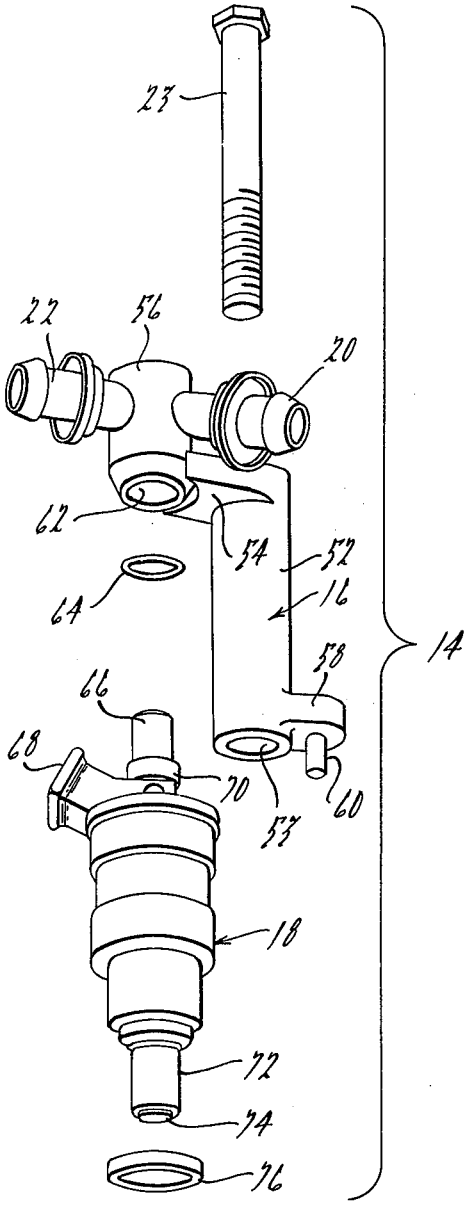
FIG. 2 is an exploded pictorial view of a fuel injector and clamp assembly.
Figure 3:
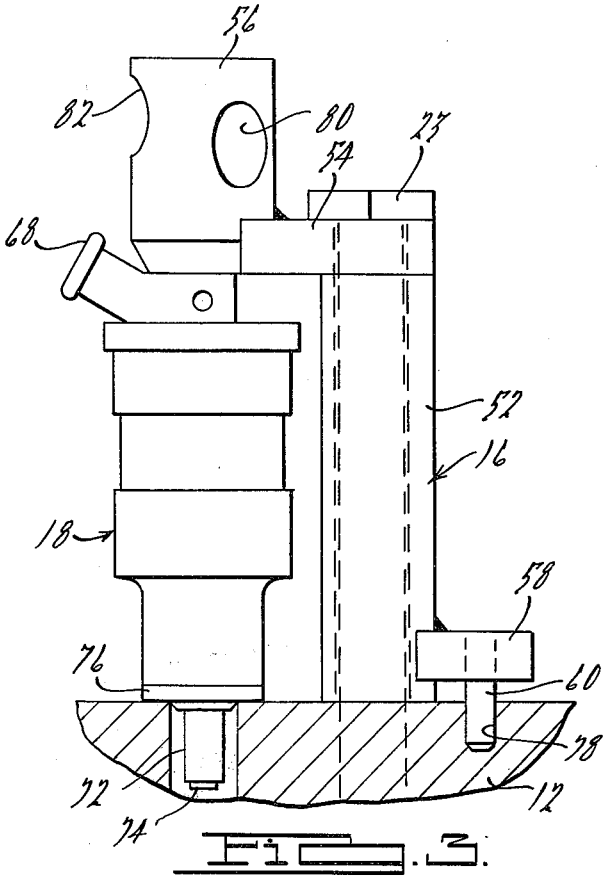
FIG. 3 is an elevational view of the fuel injector clamp assembly mounted on the intake manifold of an internal combustion engine.
Figure 4:
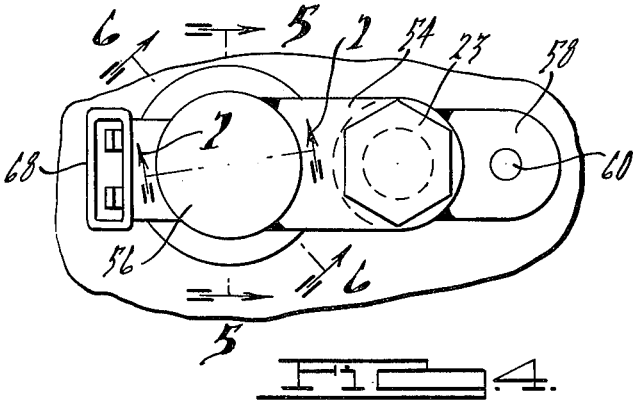
FIG. 4 is a plan view of the fuel injector clamp assembly shown in FIG. 3.
Figure 5:
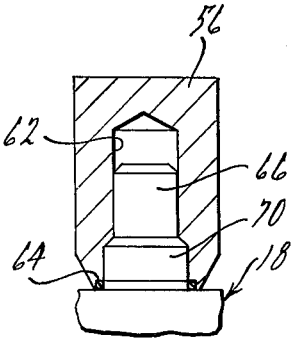
FIG. 5 is a partial sectional view taken along the line 5—5 in FIG. 4.
Figure 6:
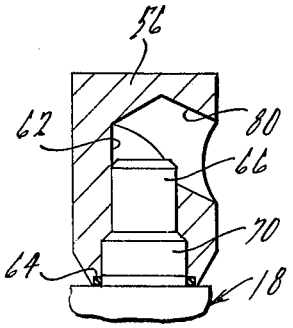
FIG. 6 is a partial sectional view taken along the line 6—6 in FIG. 4.
Figure 7:
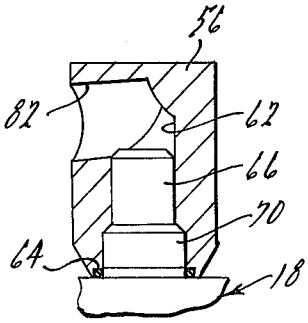
FIG. 7 is a partial sectional view taken along the line 7—7 in FIG. 4.

The apparatus of FIG. 1 includes eight fuel injector and clamp assemblies 14. Each of these assemblies includes a clamp 16, an electromagnetic fuel injector 18 and a bolt 23 used to secure the clamp 16 and fuel injector 18 to the intake manifold 12.

With particular reference to FIGS. 2 through 7, it may be seen that the clamp 16 has a first portion 56 and a second portion 52. The second portion 52 is formed from a tubular member having a central passage 53 therethrough through which the bolt 23 passes. The bolt is threaded into the intake manifold 12. A flange 58 extends outwardly from one end of the tubular portion 52 of the clamp and has a locating pin 60 which is received and cooperates with an opening in the intake manifold 12 to prevent rotation of the clamp 16 when it is secured to the intake manifold 12 by the bolt 23. At the upper portion or opposite end of the tubular portion 52, a member 54 connects the first portion 56 of the clamp with the second portion 52. The second portion of the clamp maintaining its first portion in spaced relation to the engine.

The first portion 56 of the clamp 16 has a passage 62 for receiving the inlet conduit 66 of the electromagnetic fuel injector 18. Also, the portion 56 has a fuel inlet passage 80 and a fuel outlet passage 82, both of which passages are in communication with the passage 62 that receives the fuel injector inlet conduit 66. A preferably resilient ring 64 surrounds a collar 70 on the fuel injector 18 and forms a liquid-tight seal with the end of the passage 62 in the clamp portion 56.

The electromagnetic fuel injector 18 is generally elongated in shape and has an electrical connector 68 for receiving a male member for electrically connecting the injector solenoid coil to its control circuitry (not shown). The fuel inlet conduit 66 is coaxial with the nozzle 72 at the opposite end of the fuel injector. The nozzle 72 has a discharge port 74 to permit fuel to be injected into the intake manifold of the engine. A resilient ring 76 is positioned at the upper portion of the nozzle 72 to provide a liquid-tight seal between the fuel injector 18 and the intake manifold 12.

The first portion 56 of the clamp 16 has hose fittings 20 and 22 extending from it. The fitting 20 permits the flow of fuel into the inlet passage 80 in the clamp. Fuel exits from the clamp portion 56 through the outlet passage 82 and the hose fitting 22 in communication with this passage. To avoid confusion in the drawings and to clearly illustrate the intercommunication of the passages 62, 80 and 82 in the clamp 16, FIGS. 3 through 7 are shown without the hose fittings 20 and 22.

From the above, it is clear that the clamp 16 positions and retains the fuel injector 18 on the intake manifold 12. The fuel injector 18 is located or clamped between the upper or first portion 56 of the clamp and the intake manifold 12 with the discharge nozzle and port of the fuel injector located or received by the intake manifold 12. The inlet conduit 66 of the fuel injector is received in the passage 62 in the first portion 56 of the clamp 16. The clamp not only positions and retains the fuel injector 18, but also supplies fuel to the inlet conduit 66 through the internal passages in the first portion 56 of the clamp.

With particular reference not to FIG. 1, it may be seen that fuel enters the improved fuel supply apparatus through a coupling 24 having a fitting 26 to which the output from a fuel pump or the like may be connected. In the coupling 24, the fuel flow divides as shown by the arrows. The fuel flows through flexible conduits or rubber hoses 26 and 28. The fuel flowing through the flexible conduit 26 enters the inlet opening to a clamp 30 to supply fuel to the inlet conduit of its associated fuel injector. Fuel flows from the outlet passage of this clamp 30, through a flexible conduit or rubber hose 90, into the clamp 32 associated with another fuel injector. The fuel flow continues from the outlet of the clamp 32 to the inlet of a clamp 34, and from the outlet of the clamp 34 to the inlet of a clamp 36. Thus, clamps 30, 32, 34 and 36 are connected in series. The fuel flowing from the outlet of the clamp 36 passes through the flexible conduit 38 and into a pressure regulator 40.

The fuel which flows through the flexible conduit 28 enters the inlet passage of the clamp 42 and exits from its outlet passage to flow through series-connected clamps 18, 44 and 46. Fuel discharged from the outlet of the clamp 46 passes through a flexible conduit 48 and into the pressure regulator 40. The fuel discharged from the fitting 50 on the pressure regulator is returned to the fuel supply reservoir.

The series-connected fuel supply clamps 30, 32, 34 and 36 are as a group connected in parallel with the series-connected fuel supply clamps 42, 18, 44 and 46. Of course, the various clamps supplying fuel to the fuel injectors may be interconnected in any manner desired. The use of flexible conduits interconnecting these clamps, preferably rubber hose, limits the heat transfer from the engine to the fuel and provides improved vapor-purging capability. Moreover, they permit the easy removal of a single fuel injector for repair or replacement and aid in reducing the magnitude of transient pressure fluctuations in the fuel supply system. Also, the assembly of the pressure regulator, clamps, fuel injectors, coupling and interconnecting flexible conduits may be installed as a unit on the intake manifold 12. The locating pins 60 cooperate with the openings 78 in the intake manifold to provide rapid installation of this assembly on the intake manifold, it being necessary only to secure the injectors and clamps to the manifold with the bolts 23.

Based upon the foregoing description of the invention, what is claimed is:

1. An improved apparatus for supplying fuel to a combustion engine having an intake manifold and a plurality of fuel injectors, said fuel injectors being elongated in shape and having first and second opposite ends on a common axis, said first end being located in an opening in said intake manifold and having a discharge port through which fuel may be discharged into said intake manifold, and said second end having an inlet conduit for receiving fuel to be discharged from said discharge port, wherein the improvement comprises: a separate clamp for each of said fuel injectors, each of said clamps retaining one of said fuel injectors on said intake manifold and supplying fuel to such fuel injector, each of said clamps further having an opening in which said second end of said fuel injector is positioned and having inlet and outlet passages in communication with said inlet conduit in said second end of said fuel injector, said clamp being secured to said intake manifold; a pressure regulator for regulating the pressure of fuel supplied to said apparatus, and a plurality of pieces of flexible conduit interconnecting said pressure regulator and said inlet and outlet passages of said clamps.

* * * * *